US005595632A

United States Patent [19]

Macierewicz

[11] Patent Number: 5,595,632

[45] Date of Patent: Jan. 21, 1997

[54] SHOWER FOR PAPER MAKING MACHINE

[75] Inventor: Jacek Macierewicz, Brockville, Canada

[73] Assignee: James Ross Limited, Ontario, Canada

[21] Appl. No.: 189,650

[22] Filed: Feb. 1, 1994

[51] Int. Cl.[6] ..... D21F 1/32

[52] U.S. Cl. ..... 162/277; 162/199; 162/275

[58] Field of Search ..... 162/275, 277, 162/199, 262; 198/495; 134/172, 122 R; 137/238, 240; 239/562, 243, DIG. 21, 264, 263.1

[56] References Cited

U.S. PATENT DOCUMENTS

| | | | |
|---|---|---|---|
| 1,507,608 | 9/1924 | Kidd . | |
| 3,279,976 | 10/1966 | Eagle et al. . | |
| 3,291,681 | 12/1966 | Wolf . | |
| 3,826,431 | 7/1974 | Telge | 239/562 |
| 3,910,815 | 10/1975 | Shelor | 162/277 |
| 4,087,320 | 5/1978 | Danahy et al. | 162/277 |
| 4,167,440 | 9/1979 | Falk | 162/277 |
| 4,701,242 | 10/1987 | Scarano et al. . | |
| 5,020,469 | 6/1991 | Boissevain et al. | 239/562 |
| 5,045,154 | 9/1991 | Baluha . | |
| 5,120,401 | 6/1992 | Kiviranta et al. . | |

*Primary Examiner*—Brenda A. Lamb

*Attorney, Agent, or Firm*—Birch, Stewart, Kolasch & Birch, LLP

[57] ABSTRACT

A shower for conditioning a press felt or dryer fabric in a paper making machine, including a fixed housing extending laterally of the felt or fabric, and an oscillating conduit assembly in the housing including a plurality of nozzles spaced apart in series on the conduit assembly with each nozzle having a solenoid valve associated therewith and each solenoid valve being independently controlled to selectively open or shut the solenoid valves such that selective spraying of the press felt or fabric can be provided for.

6 Claims, 2 Drawing Sheets

SHOWER FOR PAPER MAKING MACHINE

BACKGROUND OF THE INVENTION

1. Field of the Invention

The present invention relates to a shower for a paper making machine, and more particularly, to a shower for conditioning a press felt or dryer fabric on a paper making machine.

2. Description of the Prior Art

Showers are well known in paper machines for cleaning the press felt in the wet end of the machine or for cleaning the fabric in the dryer section. These showers typically include an elongated pipe extending laterally across the width of the machine, and a series of nozzles direct a plurality of jets of water or water and air at the surface of the fabric or felt for dislodging and removing dirt from the felt or fabric. In U.S. Pat. No. 1,507,608, issued Sep. 9, 1924 to H. Kidd, a shower or spray pipe is illustrated having a series of spaced-apart nozzles for spraying water onto the felt or meshed surface of a drum, and the pipe is oscillated so that the nozzles go back and forth to cover the entire width of the felt being conditioned.

U.S. Pat. No. 3,279,976, issued Oct. 18, 1966 to C. E. Eagle et al, accomplishes a similar effect by mounting a plurality of stationary pipes with the nozzles staggered, so that the complete width of the felt or fabric is covered by the nozzles. Solenoid valves are provided at the end of each pipe, and a timer connected to the solenoid valves controls the feed of cleaning solution from a header to each pipe in order to provide intermittent spraying but full width coverage.

The recovery of used water or cleaning solutions carrying the particles washed away from the felt or fabric create a further problem in that the water should be recirculated in order to reduce pollution, and thus the recycling of such water poses an expense directly proportional to the volume of water to be treated.

SUMMARY OF THE INVENTION

It is an aim of the present invention to provide an improved shower for cleaning or otherwise conditioning a felt or fabric on a paper making machine while reducing the volume of water required to condition the fabric or felt compared to prior art showers.

It is a further aim of the present invention to provide an improved shower in which any combination of individual nozzles can be activated in order to clean streaks which might develop in certain longitudinal zones of the felt or fabric.

A construction in accordance with the present invention comprises a shower including at least a conduit and an elongated rigid conduit support means having an axis extending laterally of the direction of the conveyor means to be conditioned and for the width of the conveyor means to be conditioned, a plurality of nozzles spaced apart along the conduit support means and directed at the conveyor to be conditioned, each nozzle including a valve for controlling the supply of conditioning fluid from the conduit through the nozzle, and control means for individually controlling each valve to selectively operate the individual nozzles in order to selectively spray conditioning fluid on selected longitudinal zones of the conveyor.

In a more specific embodiment of the present invention, each valve is a solenoid valve which can be remotely controlled by the control means.

In a still more specific embodiment, oscillation means are associated with the rigid conduit support means for oscillating the conduit support means linearly in its axis so that the nozzles will move to span the distance between adjacent nozzles.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

Figure 1:
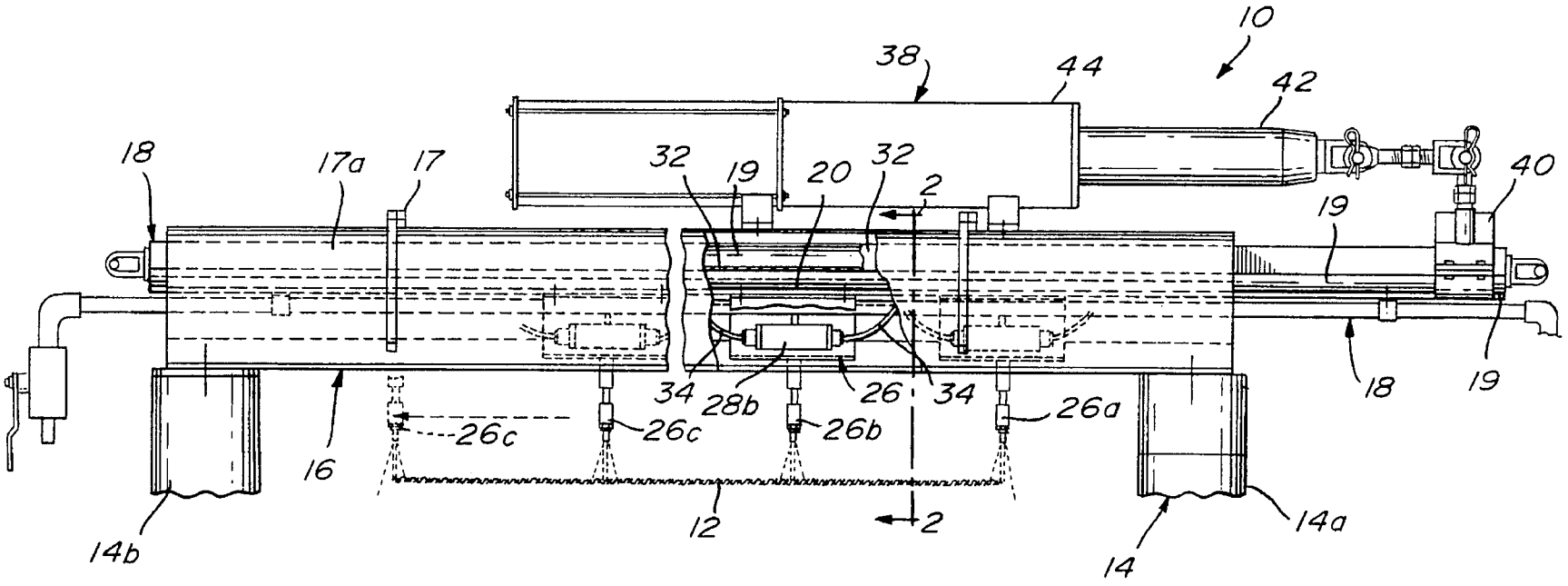
FIG. 1 is a front elevation, partly in cross-section, of a shower assembly in accordance with the present invention.

Referring now to the drawings, there is shown a shower assembly 10 extending laterally of a typical dryer fabric 12 that moves in the direction of the arrow. The shower assembly 10 includes a mounting frame 14 supporting a fixed housing 16. A slidable conduit assembly 18 slides longitudinally relative to the fixed housing 16.

The frame 14 may have vertical supports 14*a* and 14*b* while the fixed housing 16 can be fabricated from bars 17 and sheet metal plates 17*a*.

Figure 2:
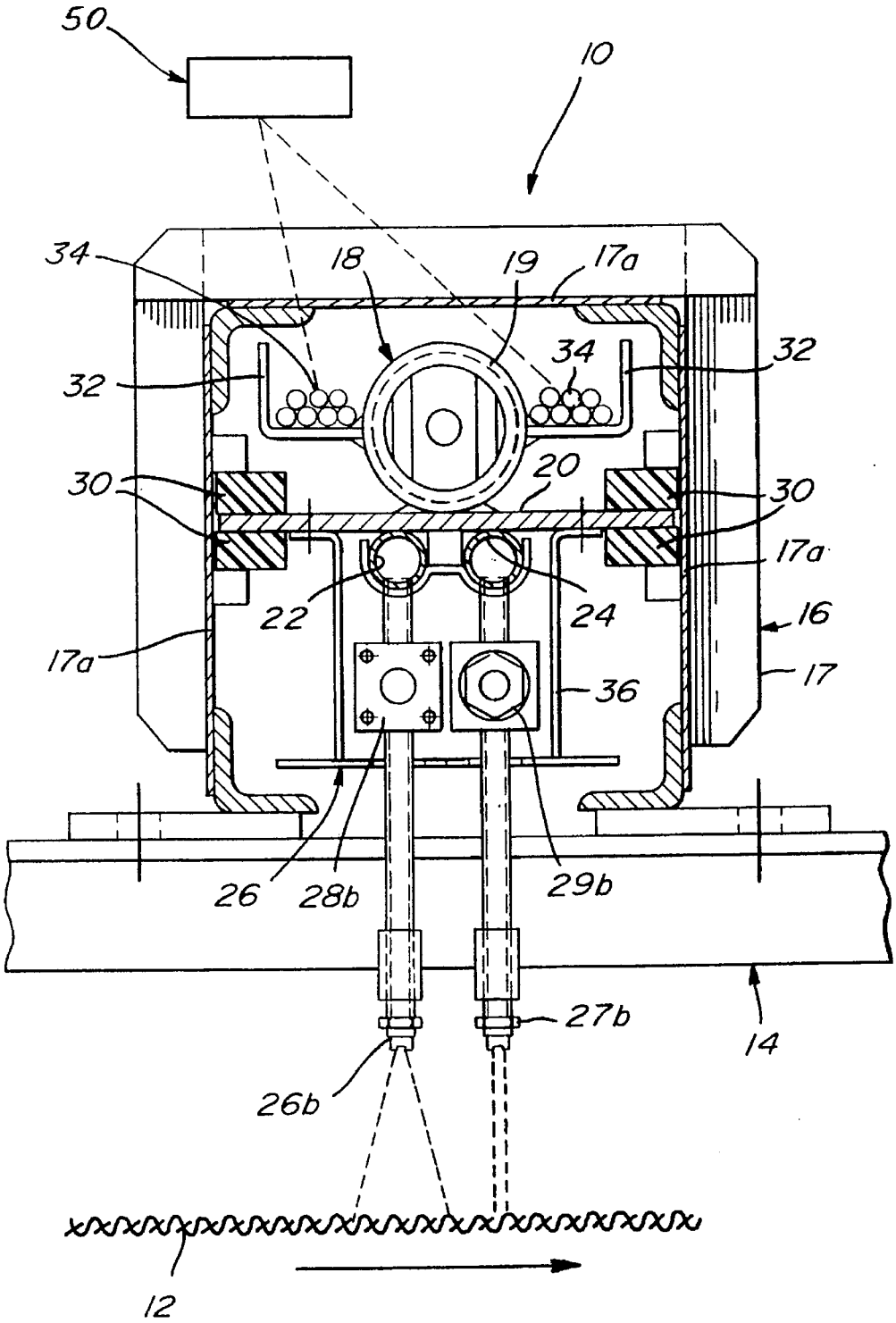
FIG. 2 is a vertical cross-section taken through line 2—2 of FIG. 1.

The conduit support assembly 18 includes a rigid tube 19 to which is welded a horizontal plate 20. The plate 20 is adapted to slide in bearing pads 30 mounted on housing walls 17*a*, as shown in FIG. 2. These pads may be Teflón or nylon bearing pads.

A plurality of nozzle assemblies 26 each include water nozzles 26*a, b, c . . . n* respectively and air nozzles 27*a, b, c . . . n* respectively. To each water nozzle 26*a, b, c . . . n* and air nozzle 27*a, b, c . . . n*, there are provided solenoid valves 28*a, b, c . . . n* and 29*a, b, c . . . n* respectively. Each valve assembly 26 is contained in a valve box 36 while the valves 26*a, b, c . . . n* and 27*a, b, c . . . n* protrude downwardly from the respective valve boxes 36 towards the conveyor 12. The solenoid valves 28*a, b, c . . . n* and 29*a, b, c . . . n* are individually connected to a control means 50 comprised of control panel (not shown) by means of wires 34. The wires 34 are grouped in wire harnesses supported on wire supports 32 welded to the rigid tube 19.

An oscillator assembly 38 is mounted on the housing 16. The oscillating assembly 38 is of the type presently supplied by James Ross Limited under the trade-mark ROSSILATOR. A cylinder 44 is mounted to the fixed housing 16 at one end thereof, and a piston 42 is connected to pipe 19 by means of a clamp 40 which can be clamped to the rigid pipe 19 so as to oscillate the support assembly 18 back and forth through the fixed housing 16. The distance of oscillation would be calibrated to represent the space between two adjacent nozzles 26*b* and 26*c*, for instance, such that in operation each nozzle spans the distance from its starting point to the starting point of an adjacent nozzle, thereby giving complete coverage in a lateral plane transverse of the fabric 12.

In operation, each individual nozzle 26*a, b, c . . . n* and 27*a, b, c . . . n* can be individually controlled so that only one or more nozzles are operated at a time. Thus, if the fabric is observed to have a dirt streak in one longitudinal zone, then only one or two water nozzles 26*b* and 26*c* as well as air nozzles 27*b* and 27*c* need be opened by the solenoid valves 28*b*, 28*c*, 29*b* and 29*c*, to allow water and air to pass through the nozzles corresponding to the dirt streak on the fabric. As can be seen, any number of combinations of nozzles can be operated in order to selectively clean or otherwise condition the fabric or felt.

Although the control panel and control circuit are not shown, one skilled in the art could easily provide an electronic circuit which allows automatic opening and shutting of the solenoid valves and manual override to control individual valves.

I claim:

1. A shower for a paper machine wherein the paper machine includes a paper fabric conveyor means movable in a paper feed direction, the shower comprising at least a fluid conduit and an elongated conduit support means having an axis extending above and across the width of the paper fabric conveyor means, a plurality of line nozzles spaced apart in series on the conduit support means and the nozzles being directed toward the paper fabric conveyor means, said conduit support means is mounted in a fixed housing extending over the paper fabric conveyor means, and the conduit support means slides within the fixed housing in the axis of the conduit support means, and oscillating means are provided for oscillating the conduit support means in the axis so that the line nozzles will move to span the distance between adjacent line nozzles, each line nozzle is associated with a valve for controlling the supply of conditioning fluid from the at least a fluid conduit through the line nozzle, and means for individually controlling each valve to selectively operate the individual line nozzles in order to selectively spray conditioning fluid on selected longitudinal zones of the paper fabric conveyor means.

2. The shower as defined in claim 1, wherein each valve is a solenoid control valve.

3. The shower as defined in claim 2, wherein each line nozzle includes a valve box mounted to the conduit support means, and the solenoid valves for each line nozzle are accommodated in the valve box with each line nozzle extending through the valve box and in the direction of the paper fabric conveyor means.

4. The shower as defined in claim 1, wherein the conduit support means includes an elongated horizontal plate element sliding in the fixed housing and supported for sliding movement by bearing blocks, said at least a fluid conduit including water conduit pipes mounted to said conduit support means, and separate air conduit pipes are also mounted to said conduit support means.

5. The shower as defined in claim 1, wherein the oscillating means includes a cylinder fixedly positioned in relation to the fixed housing, a piston extends from the cylinder near one end of the fixed housing, and a connecting link is mounted to the piston and attached to the conduit support means for oscillating the conduit support means in the axis thereof.

6. A shower for a paper machine as defined in claim 1, wherein each line nozzle travels a distance between two adjacent line nozzles and then returns to its initial position completing the oscillation cycle.

* * * * *